US007988279B2

(12) United States Patent
Sugahara

(10) Patent No.: US 7,988,279 B2
(45) Date of Patent: Aug. 2, 2011

(54) INK-DISCHARGING APPARATUS AND IMAGE-RECORDING METHOD USING THE SAME

(75) Inventor: Hiroto Sugahara, Aichi-ken (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 414 days.

(21) Appl. No.: 12/051,095

(22) Filed: Mar. 19, 2008

(65) Prior Publication Data

US 2008/0231646 A1 Sep. 25, 2008

(30) Foreign Application Priority Data

Mar. 19, 2007 (JP) ..... 2007-071052

(51) Int. Cl.
*B41J 2/01* (2006.01)

(52) U.S. Cl. ..... 347/102

(58) Field of Classification Search ..... None
See application file for complete search history.

(56) References Cited

U.S. PATENT DOCUMENTS

| | | | | |
|---|---|---|---|---|
| 6,312,103 | B1 * | 11/2001 | Haluzak | 347/45 |
| 2005/0140765 | A1 * | 6/2005 | Masumi et al. | 347/102 |
| 2005/0200676 | A1 * | 9/2005 | Kadomatsu et al. | 347/102 |
| 2006/0033794 | A1 * | 2/2006 | Yamanobe | 347/102 |

FOREIGN PATENT DOCUMENTS

| | | | |
|---|---|---|---|
| JP | 2003089198 | A | 3/2003 |
| JP | 2005096276 | A | 4/2005 |

* cited by examiner

*Primary Examiner* — Stephen D Meier
*Assistant Examiner* — Alexander C Witkowski
(74) *Attorney, Agent, or Firm* — Baker Botts L.L.P.

(57) ABSTRACT

An ink-discharging apparatus includes a discharge head discharging an ink, of which viscosity is increased by being irradiated with a predetermined energy ray, from a nozzle onto a recording medium; a first light source radiating the predetermined energy ray; and an irradiation mechanism which irradiates an energy ray for increasing the viscosity of the ink to the nozzle. When the energy ray is irradiated to the ink remaining in the nozzle, the viscosity on the surface of the ink is increased to thereby form a film which covers or closes the nozzle. As a result, it is possible, with the film, to prevent the ink located inside the film from leaking out from the nozzle even when any shock is imparted to the body of the apparatus. Further, it is possible, with the film, to prevent the viscosity of the ink, located inside the film, from further increasing.

25 Claims, 10 Drawing Sheets

INK-DISCHARGING APPARATUS AND IMAGE-RECORDING METHOD USING THE SAME

CROSS REFERENCE TO RELATED APPLICATION

The present application claims priority from Japanese Patent Application No. 2007-071052, filed on Mar. 19, 2007, the disclosure of which is incorporated herein by reference in its entirety.

BACKGROUND OF THE INVENTION

1. Field of the Invention

The present invention relates to an ink-discharging apparatus which discharges, from a nozzle, an photo-thickening ink of which viscosity is increased by receiving or being irradiated with a predetermined light beam (light) onto a recording medium to record an image, and an image-recording method using the ink-discharging apparatus.

2. Description of the Related Art

As an example of ink-discharging apparatus, there is an ink-jet recording apparatus. The ink-jet recording apparatus forms an image, for example, on a recording paper etc. as a recording medium by discharging an ink from a discharge head to the recording paper. Upon forming an image on a recording paper having permeability, such as p plain paper, there is a possibility that ink adhered to the recording paper might permeate into the paper, resulting in lowering the image quality.

In view of such situation, there is proposed an ink-discharging apparatus using UV-curable ink and including a UV light source (see Japanese patent application laid-open No. 2003-89198). This ink-discharging apparatus discharges an ink of which viscosity is increased by receiving or being irradiated with ultraviolet ray, such as a UV-curable ink, onto a recording medium; and immediately afterwards the ink-discharging apparatus makes ultraviolet ray from the UV light source to be irradiated to the UV-curable ink adhered to the recording medium so as to cure the ink, thereby suppressing the ink from permeating through the recording medium.

Irrespective of whether or not the ink-discharging apparatus uses UV-curable ink, in the ink-discharging apparatus, a meniscus is always formed in a nozzle (nozzle hole) of the discharge head through which the ink is discharged. Due to the meniscus, the ink stays or remains in the nozzle without leaking out from the nozzle. On the other hand, in a relatively compact ink-discharging apparatus particularly used in a home, the body of the apparatus (apparatus body) would often suffer from physical shock to a certain extent when the apparatus is carried for changing its installation place or when the apparatus makes contact with a user. Further, it is not completely unlikely that any object such as an edge portion of the recording paper makes contact with the nozzle. When the meniscus formed within the nozzle is destroyed due to any of these factors, there is a possibility that the ink remained in the nozzle might leak out, resulting in adhering to an inner portion of the apparatus body.

In an ink-discharging apparatus in which a UV-curable ink is used, when the leaked ink is cured inside or at inner portion of the apparatus, then there is a possibility that the driving of carriage etc. might be hindered. Further, when the UV-curable ink adhered to a platen supporting a recording medium such as recording paper is cured, then there is a possibility that the transport of the recording medium might be hindered.

SUMMARY OF THE INVENTION

An object of the present invention is to provide an ink-discharging apparatus capable of preventing the ink from leaking out from the nozzle which would be otherwise caused due to the destruction of meniscus in the nozzle and thus preventing the ink from adhering to an inner portion of the ink-discharging apparatus. Another object of the present invention is to provide an image-recording method using such an ink-discharging apparatus.

According to a first aspect of the present invention, there is provided an ink-discharging apparatus including: a discharge head having a nozzle to discharge an ink, of which viscosity is increased when a predetermined energy ray is irradiated to the ink, onto a recording medium; a first light source which radiates the predetermined energy ray; and an irradiation mechanism which irradiates an energy ray for increasing the viscosity of the ink to the nozzle.

By adopting such construction, the ink-discharging apparatus of the present invention is capable of preventing the ink remaining in the nozzle from leaking out from the nozzle due to a shock and/or the like. To explain more specifically, the ink, of which viscosity is increased by receiving the predetermined energy ray (energy ray-thickening ink), remains in the nozzle; and when energy ray is irradiated from the irradiation mechanism to the nozzle, then the viscosity on the surface of the ink which remains inside the nozzle is increased (the surface of the ink is cured) to form a film, which in turn covers or closes the nozzle (nozzle hole). As a result, even when any shock is given to the apparatus body, this film is capable of preventing the ink present or located inside the film from leaking out from the nozzle. In addition, the film is also capable of preventing the viscosity of the ink inside the film from further increasing.

Note that it is possible to adjust the thickness of the film, formed by increasing the viscosity on the surface of the ink remaining inside the nozzle (viscosity-increased portion of the ink), by adjusting or controlling an irradiation time of energy ray and/or the intensity of energy ray, irradiated from the irradiation mechanism. The thickness of the viscosity-increased portion may be extremely thin. For example, a thickness of about 2 to 3 μm is sufficient for preventing the ink inside the nozzle from leaking out from the nozzle. Further, when the viscosity-increased portion is thin as described above, the viscosity-increased portion can be removed from the nozzle by an ink discharge operation during normal image recording or during a flushing operation, without performing any special processing such as purge. The removed viscosity-increased portion merely becomes minute ink lump. Accordingly, it is possible to prevent the ink from being consumed unnecessarily due to the purge for removing the viscosity-increased portion, and there is no need to perform any special process for removing the viscosity-increased portion. Note that as the energy ray, it is possible to use, for example, ultraviolet ray, infrared ray, neutron ray etc.; and as the ink, it is possible to use ultraviolet ray-curable ink (UV ink), infrared ray-curable ink, neutron ray-curable ink, etc.

In the ink-discharging apparatus of the present invention, each of the predetermined energy ray and the energy ray irradiated to the nozzle may be a light. Further, the light may be ultraviolet ray; the first light source may be a UV light source which radiates the ultraviolet ray; and the ink may be a UV-curable ink of which viscosity is increased and is cured by being irradiated with the ultraviolet ray. With such a construction, it is possible to construct the present invention by using a UV curable ink and a UV light source which are publicly known.

In the ink-discharging apparatus of the present invention, the ultraviolet ray which the irradiation mechanism irradiates to the nozzle may be the ultraviolet ray which is radiated by the first light source. The first light source may be arranged to face a recording surface, of the recording medium, which receives the ink from the discharge head; and the irradiation mechanism may be a reflector which reflects the ultraviolet ray from the first light source to make the ultraviolet ray to be irradiated to the nozzle of the discharge head. With such a construction, it is possible to use, as a light source for radiating the ultraviolet ray to the nozzle, the first light source arranged to face the recording surface of the recording medium so that the ultraviolet ray is irradiated to the UV-curable ink, discharged onto the recording paper etc., for the purpose of preventing the ink from permeating into the recording paper.

In the ink-discharging apparatus of the present invention, the reflector may be arranged outside an ink discharge area in which the discharge head discharges the ink onto the recording medium. Although the irradiation of the ultraviolet ray to the nozzle is performed when the image formation onto the recording medium is not performed, the discharge head is generally positioned at a predetermined standby position or place located outside the ink discharge area during such period. Therefore, it is possible to arrange the reflector in such a standby position or in the vicinity of the standby position. By doing so, there is no need to move the discharge head between a position (irradiation position) at which the discharge head is located when the ultraviolet ray is irradiated to the nozzle and the standby position at which the discharge head is located during the standby time, or it is possible to reduce the time required for moving the discharge head between the irradiation position and the standby position.

In the ink-discharging apparatus of the present invention, the reflector may be arranged inside an ink discharge area in which the discharge head discharges the ink onto the recording medium. With such a construction, there is no need to provide a position or place (irradiation position or place), at which the discharge head is to be located so that the nozzle is irradiated with the ultraviolet ray, outside the ink discharge area. Therefore, it possible to reduce the size of the ink-discharging apparatus as a whole. As described above, the irradiation of the ultraviolet ray to the nozzle is performed when the image recording onto the recording medium is not performed, namely when no recording medium is present or exists in the ink discharge area. Accordingly, the recording medium does not obstruct or hinder the ultraviolet ray when the ultraviolet ray is irradiated to the nozzle even though the reflector is provided in the ink discharge area.

In the ink-discharging apparatus of the present invention, the reflector may be formed to have a reflective surface, and the reflective surface may reflect to diffuse the ultraviolet ray from the first light source. With such a construction, it is possible to diffuse the ultraviolet ray, radiated from the first light source, on the reflective surface of the reflector and to thereby widely irradiate a surface, of the discharge head, on which the nozzle is formed. Accordingly, it is possible to irradiate a plurality of nozzles (nozzle holes) formed on the surface of the discharge head with the ultraviolet ray at one time.

In the ink-discharging apparatus of the present invention, the irradiation mechanism may be a second light source which radiates the ultraviolet ray to the nozzle; the first light source may be arranged to face a recording surface, of the recording medium, which receives the ink from the discharge head; and the second light source may be arranged to face the nozzle of the discharge head. With such a construction, it is possible to provide a first light source which radiates ultraviolet ray for preventing the permeation of the ink, and second light source which radiates ultraviolet ray to the nozzle, as dedicated light sources specialized for their usages respectively.

In the ink-discharging apparatus of the present invention, the second light source may be arranged outside an ink discharge area in which the discharge head discharges the ink onto the recording medium. With such a construction, it is possible to arrange the reflector in the standby position of the discharge head or in the vicinity of the standby position. In addition, with such arrangement, there is no need to move the discharge head between the irradiation position at which the discharge head is located during the ultraviolet ray irradiation for the nozzle and the standby position at which the discharge head is located during the standby time, or it is possible to reduce the time required for moving the discharge head between the irradiation position and the standby position.

In the ink-discharging apparatus of the present invention, the second light source may be arranged inside an ink discharge area in which the discharge head discharges the ink onto the recording medium. With such a construction, it is possible to reduce the size of the ink-discharging apparatus as a whole.

The ink-discharging apparatus of the present invention may further include a controller which controls a radiation of the first light source; wherein the controller may control the first light source to perform the radiation so that the ultraviolet ray is irradiated to the nozzle after a predetermined time is elapsed since the discharge head discharged the ink onto the recording medium last time. With such a construction, when a state that the image forming operation for the recording medium is not performed is continued or maintained for a predetermined time, then the ultraviolet ray is automatically irradiated to the nozzle, thereby preventing the ink from leaking from the nozzle.

The ink-discharging apparatus of the present invention may further include a controller which controls a radiation of the first and the second light sources; and the controller may control the second light source to perform the radiation so that the ultraviolet ray is irradiated to the nozzle after a predetermined time is elapsed since the discharge head discharged the ink onto the recording medium last time. With such a construction, when a state that the image forming operation for the recording medium is not performed is continued or maintained for a predetermined time, then the ultraviolet ray is automatically irradiated to the nozzle, thereby preventing the ink from leaking from the nozzle.

In the ink-discharging apparatus of the present invention, the first light source and the discharge head may be integrally formed.

According to a second aspect of the present invention, there is provided an image-recording method for recording an image on a recording medium, the method including: discharging an ink, of which viscosity is increased when an energy ray is irradiated to the ink, from a nozzle formed in a discharge head onto the recording medium; irradiating an energy ray to the ink discharged onto the recording medium; and irradiating an energy ray for increasing the viscosity of the ink to the nozzle when the ink is not discharged from the discharge head.

According to the second aspect of the present invention, since an ink of which viscosity is increased by receiving an energy ray (energy ray-thickening ink) and which is remaining in the nozzle is irradiated with an energy ray, the viscosity on the surface of the ink is increased to form a film, which in turn covers or closes the nozzle (nozzle hole). As a result, even when any shock is given to the apparatus body, this film is capable of preventing the ink present or located inside the film from leaking out from the nozzle. In addition, the film is also capable of preventing the viscosity of the ink inside the film from further increasing.

In the image-recording method of the present invention, the ink of which viscosity is increased when the energy ray is irradiated to the ink may be an ink of which viscosity is increased when light is irradiated to the ink; and each of the energy ray irradiated to the ink discharged onto the recording medium and the energy ray irradiated to the nozzle may be light. Further, the light may be ultraviolet ray.

In the image-recording method of the present invention, the ultraviolet ray irradiated to the nozzle may be the ultraviolet ray to be irradiated to the ink discharged onto the recording medium; and the ultraviolet ray may be irradiated to the nozzle by reflecting the ultraviolet ray to be irradiated to the ink discharged onto the recording medium.

The image-recording method of the present invention may further include: measuring an elapsed time elapsed since the ink is discharged from the nozzle last time; and comparing the measured elapsed time with a predetermined time; wherein the ultraviolet ray may be irradiated to the nozzle when the measured elapsed time is longer than the predetermined time.

The image-recording method of the present invention may further include moving the discharge head to a position at which the discharge head does not face the recording medium and irradiating the ultraviolet ray to the nozzle.

In the image-recording method of the present invention, a meniscus may be formed with the ink in the nozzle, and the ink forming the meniscus may be cured by irradiating the ultraviolet ray to the nozzle, and the image-recording method of the present invention may further include removing the cured ink by applying discharge pressure to the ink in the nozzle.

BRIEF DESCRIPTION OF THE DRAWINGS

FIGS. 9A to 9C are each a partially enlarged schematic view of the construction of a reflector, wherein FIG. 9A shows a construction in which irregularities (convex and concave portions) are provided on a reflective surface of the reflector, FIG. 9B shows a construction in which the reflector is provided with a surface layer portion formed of a resin which is of a milky white color and which has translucency (light transmittance), and FIG. 9C shows a construction in which the reflector has a reflective surface formed as a convexly curved surface;

DESCRIPTION OF THE PREFERRED EMBODIMENTS

In the following, an ink-discharging apparatus according to an embodiment of the present invention will be specifically described with reference to the drawings.

Figure 1:
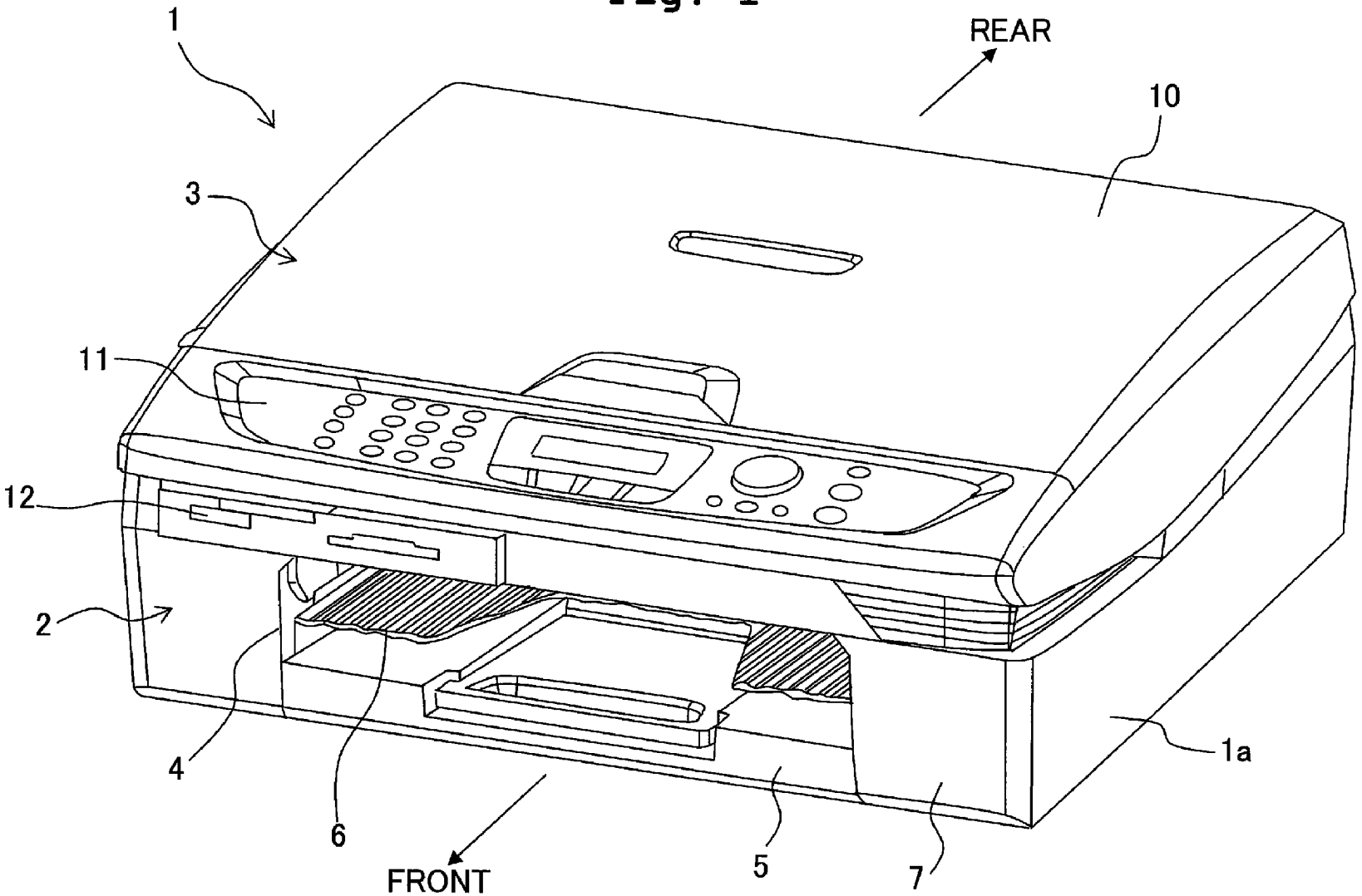
FIG. 1 is a perspective view of the outer appearance of an ink-discharging apparatus according to an embodiment of the present invention.

FIG. 1 is a perspective view of the outer appearance of an ink-discharging apparatus 1 according to an embodiment of the present invention. FIG. 1 shows a so-called multi-function machine as the ink-discharging apparatus 1 according to the embodiment of the present invention. As shown in FIG. 1, the ink-discharging apparatus 1 is a multi-function machine including a casing 1*a* having a substantially rectangular parallelepiped shape; a printer section 2 which records an image by ink-jet system and which is arranged at a lower portion of the casing 1*a*; and a scanner section 3 arranged at an upper portion of the casing 1*a*. The ink-discharging apparatus 1 has the printer function, scanner function, copy function, and facsimile function.

As shown in FIG. 1, the printer section 2 of the ink-discharging apparatus 1 has an opening 4 on the front side of the casing 1*a*. Inside the opening 4, there are provided a paper feed tray 5 and a discharged paper tray 6 in a two-tier manner on the lower and upper sides of the opening 4 respectively. The paper feed tray 5 can accommodate a plurality of sheets of recording paper as recording media. For example, a plurality of sheets of recording paper of various sizes of not larger than A4 size can be accommodated.

A door 7 is openably/closably provided in the lower right portion in the front side of the printer section 2, and a main tank placing section 8 (see FIG. 2) is provided inside the door 7. At the main tank placing section 8, a main tank 9 (also referred to as "ink cartridge", see FIG. 2) is placed or mounted. Accordingly, when the door 7 is opened, the main tank placing section 8 is exposed to the front side, and the main tank 9 is detachably or removably provided with respect to the main tank placing section 8. The main tank placing section 8 is provided with accommodating chambers corresponding to color inks used in the ink-discharging apparatus 1, respectively. In the printer section 2, four color inks, namely cyan ink (C), magenta ink (M), yellow ink (Y) and black ink (Bk) are used. Accordingly, the main tank placing section 8 is divided or partitioned into four accommodating chambers, and the main tank 9 is constructed to store the cyan ink (C), the magenta ink (M), the yellow ink (Y) and the black ink (Bk) in the accommodating chambers respectively.

The scanner section 3, arranged at the upper portion of the ink-discharging apparatus 1, is constructed as a so-called flat bed scanner. Namely, as shown in FIG. 1, a document cover 10 is arranged openably/closably on the upper surface of the ink-discharging apparatus 1, and is provided as the top plate of the ink-discharging apparatus 1. Further, a platen glass on which a document is placed and an image sensor which reads an image and/or a letter of a document are arranged below or under the document cover 10.

An operation panel 11 via which the printer section 2, the scanner section 3, etc. can be operated is arranged in the upper portion of the front side of the ink-discharging apparatus 1. The operation panel 11 is constructed of various operation buttons, a liquid crystal display, etc. The ink-discharging apparatus 1 is operable based on an instruction outputted from the operation panel 11 as a result of an operation by the user via the operation panel 11. When the ink-discharging apparatus 1 is connected to an external computer, the ink-discharging apparatus 1 is operable also based on an instruction transmitted from the computer via a printer driver or a scanner driver.

A slot 12 is arranged in the upper left portion in the front side of the ink-discharging apparatus 1. Various compact memory cards as storage media can be inserted into the slot 12. By performing a predetermined operation on the operation panel 11, data stored in the compact memory cards inserted into the slot 12 can be read out. Further, it is possible to display the read data on the liquid crystal display of the operation panel 11; and it is possible to record, by the printer section 2, an arbitrarily selected image on the recording paper based on the read date displayed on the liquid crystal panel.

Figure 2:
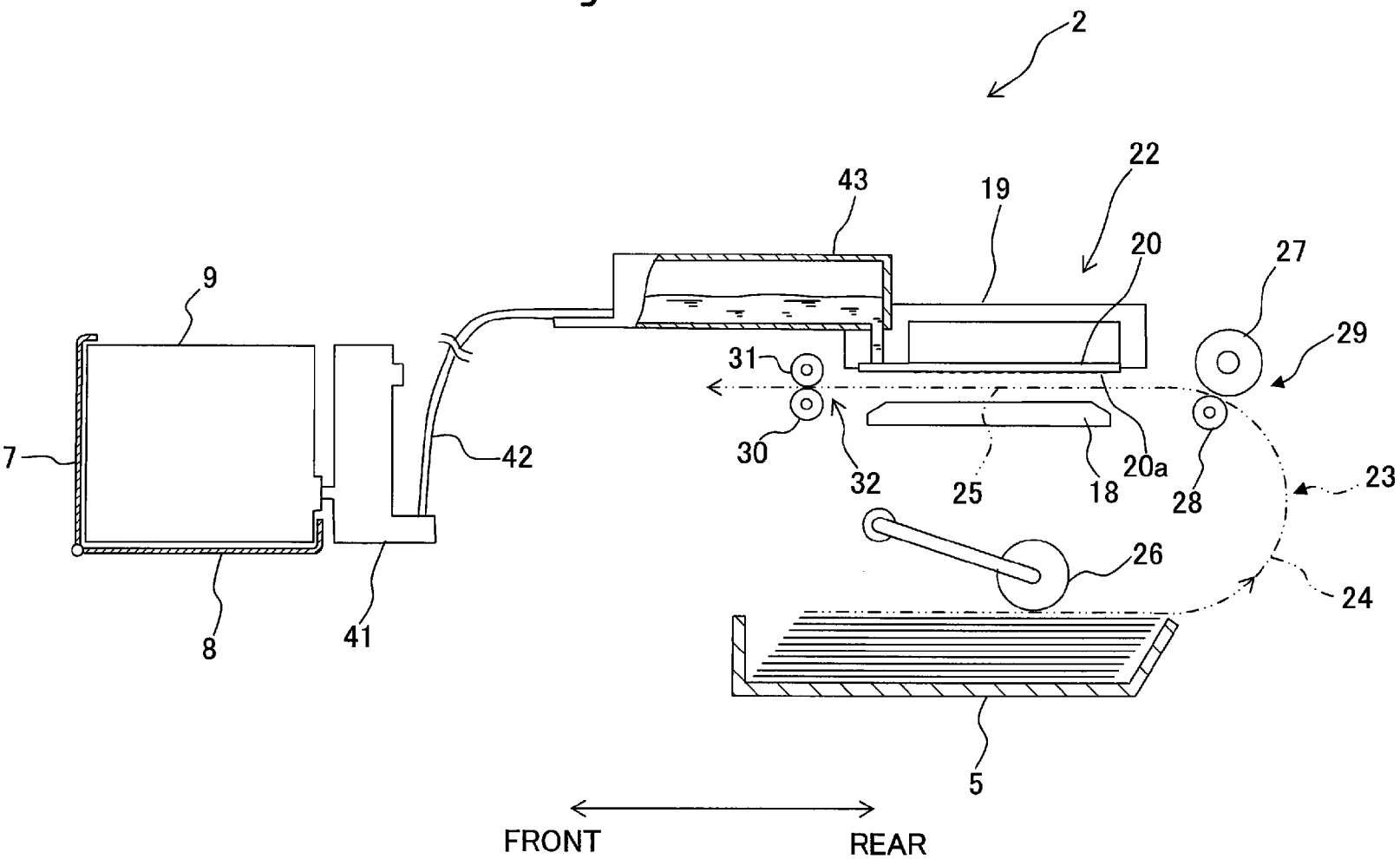
FIG. 2 is a schematic sectional view of the construction of a printer section provided in the ink-discharging apparatus shown in FIG. 1.
Figure 3:
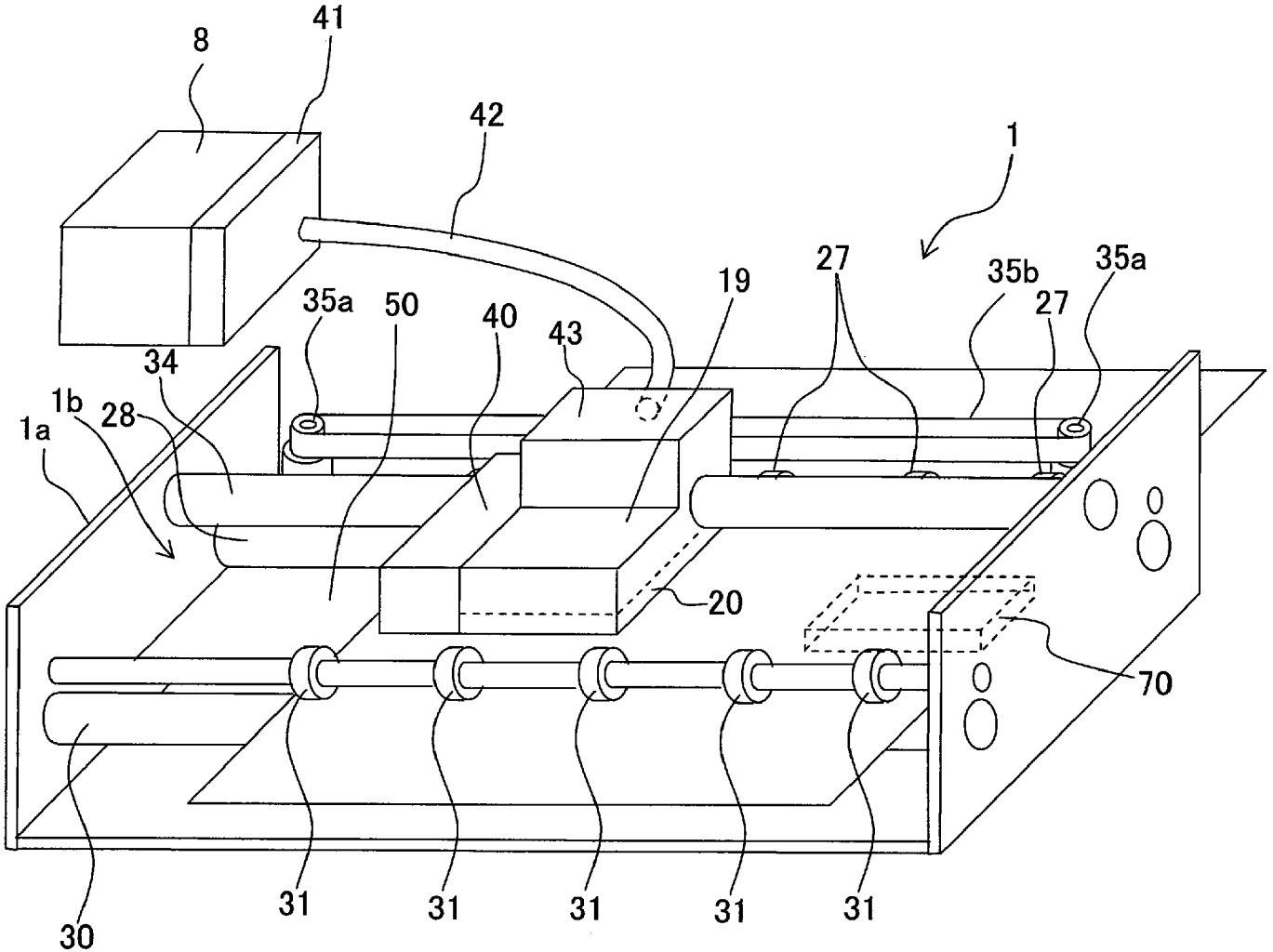
FIG. 3 is a schematic perspective view of the construction of the printer section shown in FIG. 2.

FIG. 2 is a schematic sectional view showing the construction of the printer section 2, and FIG. 3 is a schematic perspective view showing the construction of the printer section 2. As shown in FIG. 2, the paper feed tray 5 is provided in the vicinity of the bottom portion of the ink-discharging apparatus 1, and a platen 18 which is plate-shaped and is long or elongated in the right-left direction is arranged above or over the paper feed tray 5. Further, above the platen 18, there is provided an image recording unit 22 including a carriage 19 and an discharge head 20 which discharges the ink from nozzles 20*a* and which is mounted (provided) on the carriage 19. A paper transport path 23 is formed as extending from the rear portion of the paper feed tray 5. The paper transport path 23 includes a curved path 24 which is curved upwardly from the rear portion of the paper feed tray 5 and which further heads toward the front side of the ink-discharging apparatus 1; and a straight path 25 extending further toward the front side of the ink-discharging apparatus 1 from the terminal or end of the curved path 24. The paper transport path 23 is constructed of an outer guide plane and an inner guide plane which face with each other at a predetermined distance, at portions of the paper transport path 23 which are different from an arranging position or place at which the image recording unit 22 is arranged.

A paper feed roller 26 which supplies (feeds) the recording paper in the paper feed tray 5 to the paper transport path 23 is provided immediately above the paper feed tray 5. In the vicinity of the downstream portion of the curved path 24 in the paper transport path 23, a pair of transport rollers 29 constructed of a transport roller 27 and a transport-pinch roller 28 are provided so as to sandwich the paper transport path 23 from above and below by the transport roller 27 and the transport-pinch roller 28 respectively. Further, in the vicinity of the downstream portion of the straight path 25 in the paper transport path 23, a pair of paper discharge rollers 32 constructed of a paper discharge roller 30 and a discharge-pinch roller 31 are provided so as to sandwich the paper transport path 23 from above and below by the discharge-pinch roller 31 and the paper discharge roller 30 respectively. The discharge head 20 and the platen 18 as described above are provided so that the discharge head 20 and the platen 18 sandwich the straight path 25 from above and below, respectively, at a portion of the straight path 25 located between the pair of transport rollers 29 and the pair of paper discharge rollers 32.

As shown in FIG. 3, the carriage 19 is supported by a guide rod 34 extending in the right-left direction (the longitudinal direction of the platen 18) so that the discharge head 20 is slidably movable in the right-left direction. Further, the carriage 19 is connected to a belt 35*b* wound between pulleys 35*a*, 35*a* arranged apart from each other in the right-left direction. The pulleys 35*a* and the belt 35*b* are forwardly/reversely rotatable by the drive of a carriage motor 35 (see FIG. 5). Based on the rotation of the pulleys 35*a* and belt 35*b*, the carriage 19 and the discharge head 20 placed on the carriage 19 are movable within a predetermined range in the right-left direction along the guide rod 34.

Accordingly, the recording paper in the paper feed tray 5 is supplied to the paper transport path 23 by the paper feed roller 26, and then is transported on the transport path 23 from the curved path 24 to the straight path 25 by the pair of transport rollers 29. The recording paper arriving at the straight path 25 is subjected to image recording to have an image recorded on the recording paper, while passing through the straight path 25, with the ink discharged from the discharge head 20 arranged to face the recording paper. When the recording is completed, the recording paper is discharged from the straight path 25 by the pair of paper discharge rollers 32, and then is accommodated by the discharged paper tray 6 (see FIG. 1). Thus, an area, in the straight path 25, which faces the discharge head 20 is an ink discharge area 37 (see FIG. 4). By discharging the ink from the discharge head 20 when the recording paper is located in the ink discharge area 37, an image can be recorded on the recording paper.

As the ink to be discharged from the discharge head 20, the ink-discharging apparatus 1 according to the embodiment adopts an photo-thickening ink which is thickened or of which viscosity is increased by receiving a predetermined light, and more specifically, a UV-curable ink of which viscosity is increased by receiving ultraviolet ray and is cured (hereinafter referred to as "UV ink"). As shown in FIG. 3, the ink-discharging apparatus 1 has a first UV light source 40 (first light source) which radiates or emits ultraviolet ray and which is provided integrally with the discharge head 20 at a side of the discharge head 20. The first UV light source 40 is arranged to face a recording surface, of the recording paper, which receives the UV ink from the discharge head 20. Namely, the first UV light source 40 is arranged so that an irradiation direction in which the ultraviolet ray from the first UV light source 40 is irradiated downwardly is substantially same as a discharge direction of the UV ink in which the UV ink discharged from the discharge head 20 flies downwardly. The first UV light source 40 radiates ultraviolet ray so that the ultraviolet ray is irradiated to the UV ink discharged from the discharge head 20 and adhered to the recording paper, thereby increasing the viscosity of the UV ink on the recording surface to cure the UV ink and suppressing the UV ink from permeating into the recording paper.

As shown in FIGS. 2 and 3, the UV ink is supplied from the main tank 9 placed to the main tank placing section 8 to a buffer tank 43 connected to an upper portion of the discharge head 20 via a sub-tank 41 for air/liquid separation and an ink-supply flexible tube 42, and then the UV ink is supplied from the buffer tank 43 to the discharge head 20. Namely, the main tank 9 has a predetermined capacity (volume) for storing the ink, and when the main tank 9 is placed on the main tank placing section 8, the main tank 9 communicates with the sub-tank 41 located adjacently to the main tank placing section 8. The sub-tank 41 has a volume smaller than that of the main tank 9 and is capable of storing the UV ink inflowed from the main tank 9 into the sub-tank 41 in a state that the sub-tank 41 is communicated with the main tank 9. The UV ink stored in the sub-tank 41 is supplied to the discharge head 20, based on an operation of an actuator (not shown) included in the discharge head 20, to be discharged from the nozzles 20*a*.

In general, the nozzles of an discharge head each always has a meniscus formed with the ink therein even during a period of time when the discharge head is not driven or operated (namely, even in a state that the ink is not actively discharged as during the image recording operation or the flushing operation). Accordingly, due to the meniscus formed with the ink in the nozzle, the ink remains in the nozzle without leaking out from the nozzle. However, when any physical shock is given to the apparatus body, or an object such as an edge portion of the recording paper makes contact with the nozzle, there is a fear that the meniscus formed in each of the nozzles might be destroyed and thus the ink remained in the nozzle might leak from the nozzle. In view of such situation, the ink-discharging apparatus 1 according to this embodiment is provided with an ink viscosity-increasing mechanism 45 which increases the viscosity of the UV ink forming meniscus in each of the nozzles 20*a* in order to prevent the UV ink from leaking out from the nozzles 20*a* when the discharge head 20 is not driven or operating. In the following, a plurality of examples regarding constructions of the ink viscosity-increasing mechanism 45 having the above-described construction will be described.

FIRST EXAMPLE

Figure 4:
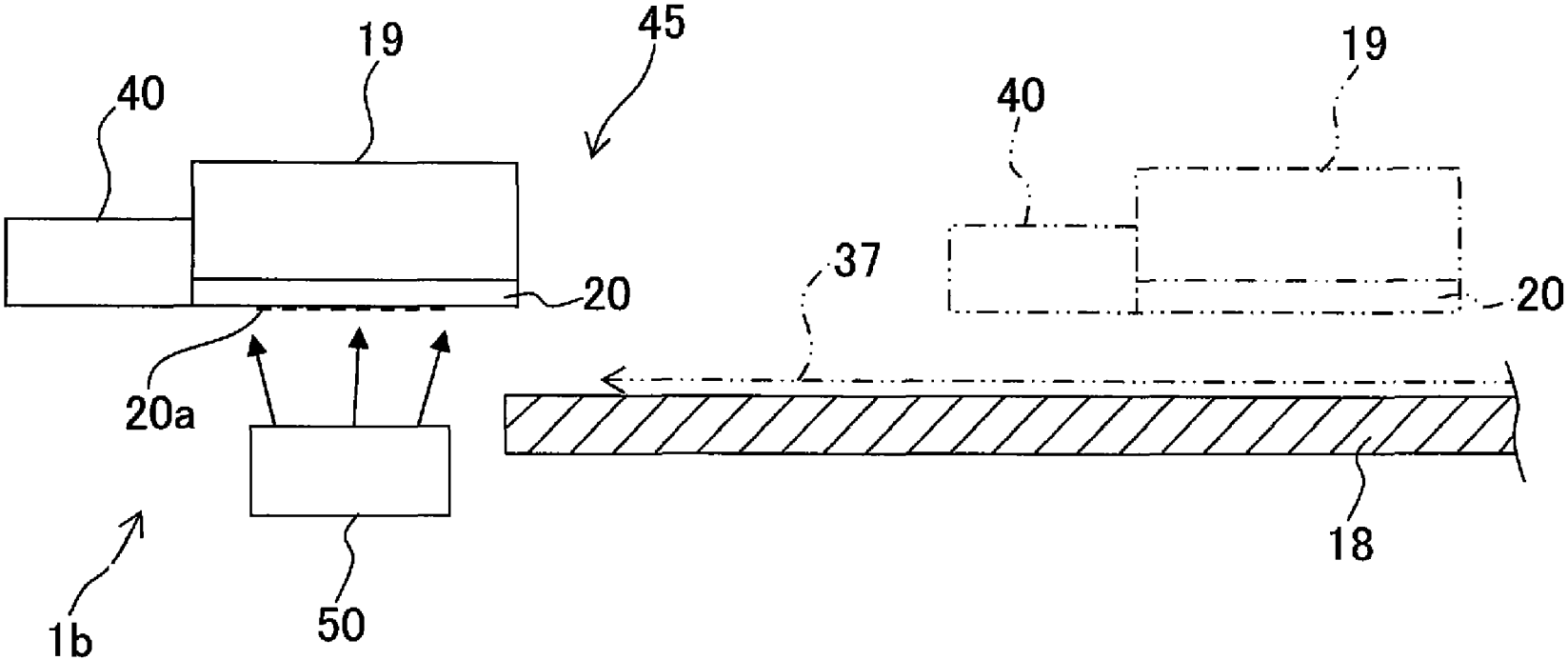
FIG. 4 is a schematic front view of the construction of an ink viscosity-increasing mechanism provided in the ink-discharging apparatus shown in FIG. 1, according to a first example of the present invention.

FIG. 4 is a schematic front view showing the construction of an ink viscosity-increasing mechanism 45 according to the first example. As shown in FIG. 4, the ink viscosity-increasing mechanism 45 has, in addition to the first UV light source 40, a second UV light source 50 (second light source, irradiation mechanism) provided outside the ink discharge area 37 in which the image can be recorded onto the recording paper by the discharge head 20 (see also FIG. 3). A space 1*b* is present or secured, in the casing 1*a*, in the vicinity of a side of the platen 18, the side being outside the ink discharge area 37. A standby position as a place at which the discharge head 20 stands by when the discharge head 20 is not operating and an irradiation position at which the nozzles 20*a* is irradiated with ultraviolet ray are defined in the space 1*b*. The second UV light source 50 is arranged at the irradiating position so that the second UV light source 50 does not protrude upwardly beyond the upper surface of the platen 18.

The second UV light source 50 is constructed of a light-emitting diode (LED) emitting ultraviolet ray, and/or the like, and the second UV light source 50 is capable of irradiating the ultraviolet ray in an upward direction by light emission of the LED. The discharge head 20 stands by at the standby position in the space 1*b* when the discharge head is not operating. Further, the discharge head 20 is movable integrally with the first UV light source 40 also to the irradiation position, in the space 1*b*, at which the discharge head 20 faces or is opposite to the second UV light source 50 by the drive of the carriage motor 35 (see FIG. 5). In FIG. 4, a position of the carriage 19, discharge head 20 and the first UV light source 40 when the carriage 19, the discharge head 20 and the first UV light source 40 are located in the ink discharge area 37 is indicated by double dot chain lines.

Figure 5:
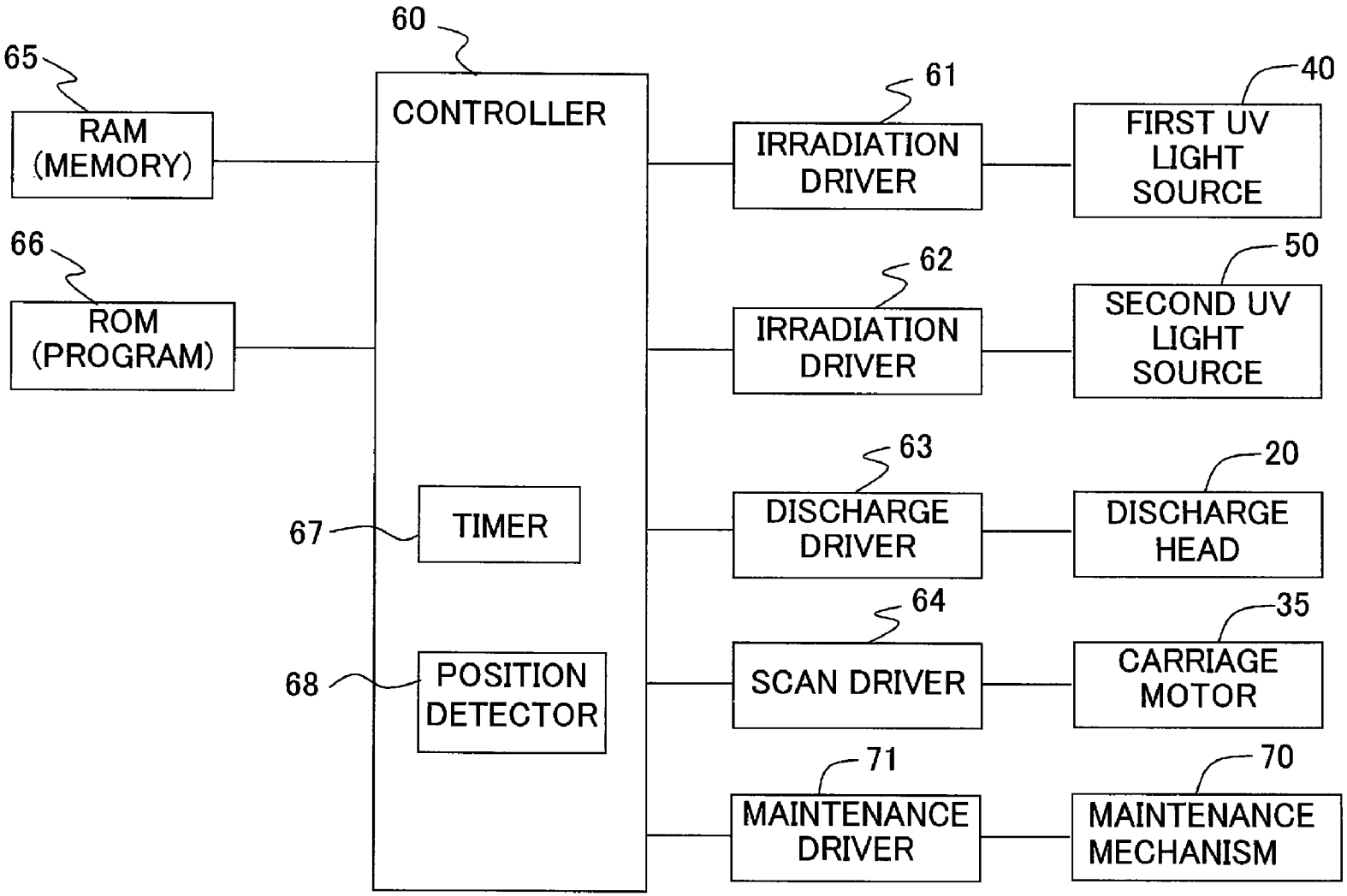
FIG. 5 is a block diagram for explaining a function of the ink-discharging apparatus.

FIG. 5 is a block diagram for explaining the function of the ink-discharging apparatus 1. As shown in FIG. 5, the ink-discharging apparatus 1 has a controller 60 to which the first UV light source 40 and the second UV light source 50 as described above are connected via irradiation drivers 61 and 62, respectively. The irradiation drivers 61 and 62 convert control signals from the controller 60 into drive signals for driving the first UV light source 40 and the second UV light source 50, and output these drive signals to the first UV light source 40 and the second UV light source 50, respectively.

Further, the discharge head 20 (to be exact, an actuator, such as a piezoelectric element, provided for ink ejection in the discharge head 20) is connected to the controller 60 via a discharge driver 63, and the carriage motor 35 is connected to the controller 60 via a scan driver 64. The discharge driver 63 converts a control signal from the controller 60 into a drive signal, and outputs the drive signal to the discharge head 20. The controller 60 controls ink-discharge amount and ink-discharge timing of the ink from the discharge head 20, etc. The scan driver 64 converts a control signal from the controller 60 into a drive signal, and outputs the drive signal to the carriage motor 35. The controller 60 controls the rotational direction, rotational speed and rotational angle of the carriage motor 35, namely the controller 60 controls the moving direction, moving speed and moving distance of the discharge head 20. Further, as shown in FIG. 5, the controller 60 has a maintenance mechanism 70 which is connected to the controller 60 via a maintenance driver 71 and which performs maintenance for the discharge head 20 and maintains the discharge state of the ink (ink-discharge state) from the nozzles 20*a*. The controller 60 controls the maintenance mechanism 70 via the maintenance driver 71 to make the maintenance mechanism 70 perform, for example, a flushing operation and a purge operation for the discharge head 20.

Further, a RAM 65 which temporarily stores calculation result etc., and a ROM 66 which stores programs for controlling operations of the ink-discharging apparatus 1 are connected to the controller 60. The controller 60 is capable of executing all the operations in accordance with the programs in the ROM 66, and makes calculation results occurring as a result of the operation execution be temporarily stored in the RAM 65.

The controller 60 further includes a timer 67 and a position detector 68. Although the timer 67 and the position detector 68 are of software type functioning by the execution of the programs in the ROM 66, it is allowable to realize the timer 67 and the position detector 68 by a hardware type structure constructed by electronic circuitry, instead of the software. The timer 67 is capable of measuring an elapsed time elapsed since the state of the discharge head 20 became a non-operation state, as will be described later. The position detector 68 is capable of detecting the position of the discharge head 20 (the ink discharge area, standby position, and irradiation position of the discharge head 20) based on the control signal outputted to the scan driver 64.

Figure 6A:
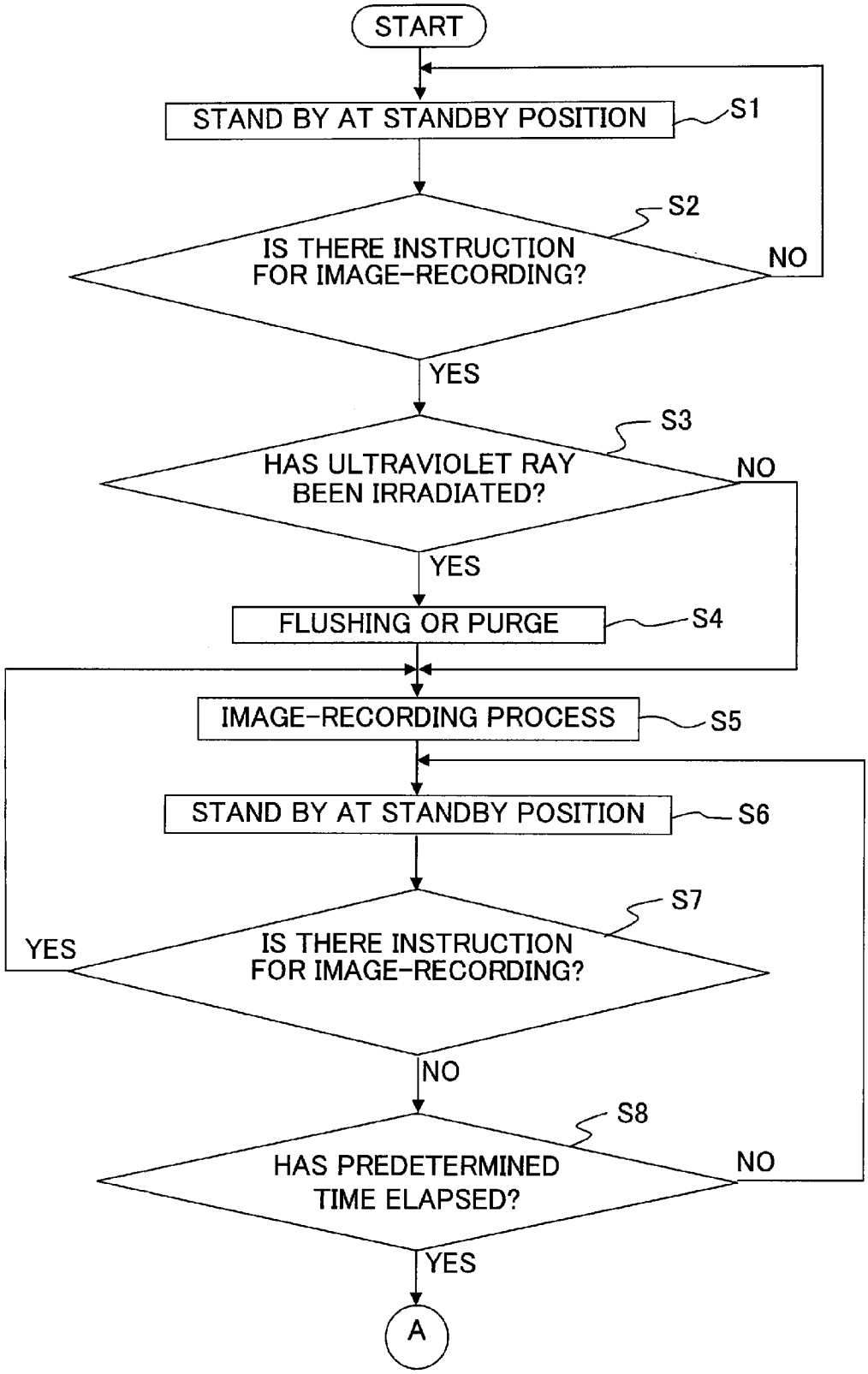
FIGS. 6A and 6B are a flow chart showing an operation of the ink-discharging apparatus for preventing UV ink from leaking out from nozzles when the ink-discharging apparatus is not operating.
Figure 6B:
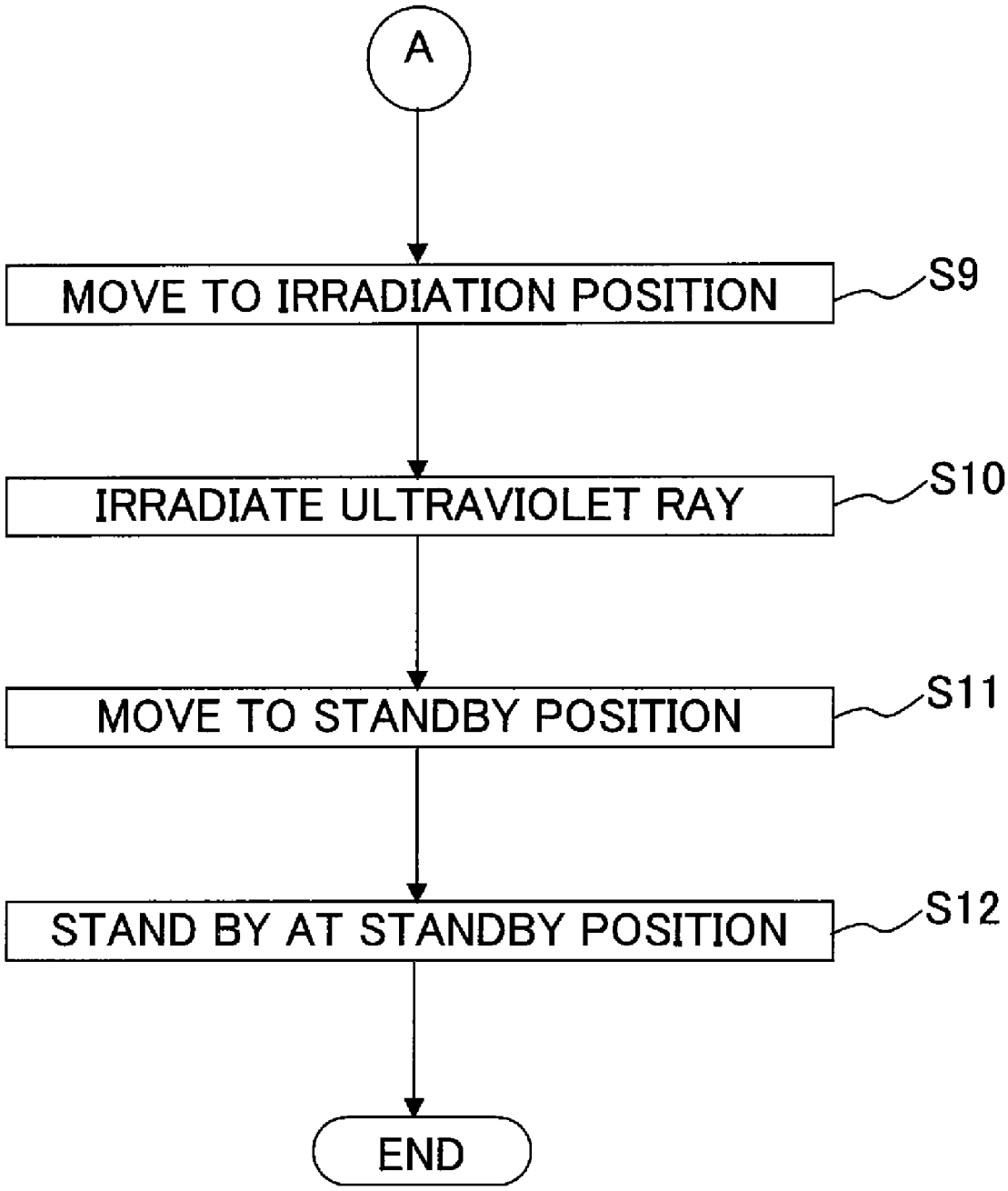

Next, an explanation will be given about an operation for preventing the UV ink from leaking out from the nozzles 20*a* in the above-described ink-discharging apparatus 1 during the time period when the discharge head 20 is in the non-operation state (when the discharge head 20 is not operated). FIGS. 6A and 6B are a flow chart showing the operation of the ink-discharging apparatus 1 during the leaking preventing operation.

As shown in FIGS. 6A and 6B, in a state that the discharge head 20 stands by at the standby position (S1), when the controller 60 provided for the ink discharging apparatus 1 receives an image-recording instruction for recording an image (S2: YES), then the controller 60 judges, based on a UV-irradiation flag stored in the RAM 65, whether or not the ultraviolet ray has been irradiated to the nozzles 20*a* of the discharge head 20 (S3). Here, the term "UV irradiation flag" means a flag indicating whether or not the ultraviolet ray has been irradiated to the nozzles 20*a* of the discharge head 20. On the other hand, when there is no image-recording instruction (S2: NO), the controller 60 makes the discharge head 20 stand by at the standby position. In Step S3, when the UV irradiation flag is ON and it is judged that the ultraviolet ray has been irradiated to the nozzles 20*a* (S3: YES), then the controller 60 controls the maintenance mechanism 70 to perform the flushing or purge operation for the nozzles 20*a* (S4); and after the controller 60 turns the UV irradiation flag OFF, the controller 60 controls the discharge head 20 to perform an image recording process (S5). On the other hand, in Step S3, when the UV irradiation flag is OFF and the controller 60 judges that the ultraviolet ray has not been irradiated to the nozzles 20*a* (S3: NO), then the controller 60 controls the discharge head 20 to perform the image recording process, without performing the flushing or purge operation. After the image recording process is completed, the controller 60 controls the discharge head 20 to move to the standby position in the space 1*b* and makes the discharge head 20 stand by at the standby position (S6). At this time, the position detector 68 detects whether or not the discharge head 20 is located at the standby position. When there is an image recording instruction in the state that the discharge head 20 stands by at the standby position (S7: YES), then the process returns to Step S5, and the image recording process is executed. On the other hand, when there is no image recording instruction in the state that the discharge head 20 stands by at the standby position (S7: NO), then the timer 67 of the controller 60 measures an elapsed time elapsed since the discharge head 20 was located at the standby position, and judges whether or not a preset, predetermined time has been elapsed (S8). Here, although the time when the discharge head 20 is moved and is located at the standby position is assumed as a starting time of the elapsed time measured by the timer 67, the starting time of the elapsed time is not limited to this. For example, the starting time of the elapsed time measured by the timer 67 may be a point of time when the discharge head 20 is started to move toward the standby position. Alternatively, the starting time of the elapsed time measured by the timer 67 may be a point of time when it is judged that the image recording process for recording image onto the recording paper by the ink-discharging apparatus 1 has been completed, namely a point of time when it is judged that the last discharge of the UV ink for image recording has been completed. Namely, it is enough that judgment is made that the non-operation state of the discharge head 20 is continued or maintained for a predetermined time period.

If it is judged in Step S8 that the preset time has not elapsed (S8: NO), then the discharge head 20 continue to stand by at the standby position (S6). On the other hand, if it is judged in Step S8 that the preset time has elapsed (S8: YES), then the controller 60 moves the discharge head 20 to the irradiation position at which the discharge head 20 faces the second UV light source 50 (S9). Then, the controller 60 makes the second UV light source 50 to radiate the ultraviolet ray having a predetermined intensity to be irradiated to the discharge head 20 for a predetermined time (S10). After the completion of the irradiation, the controller 60 makes the UV irradiation flag, stored in the RAM 65, to be ON. Afterwards, the controller 60 controls the discharge head 20 to move again to the standby position (S11), and makes the discharge head 20 to stand by at the standby position (S12).

When the non-operation state of the discharge head 20 is continued by the above-described operation of the ink-discharging apparatus 1 for a predetermined time, the ultraviolet ray is irradiated to the nozzles 20*a* of the discharge head 20, then the viscosity of a portion of the surface layer (surface layer portion) of the UV ink remaining in the nozzles 20*a* is increased (to be formed as a viscosity-increased portion), thereby curing the surface layer portion of the UV ink. As a result, a film covering or closing each of the nozzles 20*a* is formed by the viscosity-increased portion, thereby preventing, with the film, the UV ink located behind the film from leaking out from each of the nozzles 20*a*.

The intensity and irradiation time of ultraviolet ray radiated from the second UV light source 50 can be appropriately adjusted. However, as the intensity of the ultraviolet ray is stronger and the irradiation time of ultraviolet ray is longer, the degree at which the viscosity of the UV ink is increased or the thickness of the viscosity-increased portion becomes thicker. When the viscosity of the UV ink is increased in the nozzle 20*a* and thus to be cured to an extent greater than a predetermined value, or when the thickness of the viscosity-increased portion is thicker than a predetermined value, then the UV ink of which viscosity is increased cannot be removed unless resorting to a forcible means such as the purging. It is therefore desirable to set the intensity and irradiation time of ultraviolet ray radiated from the second UV light source 50 so that the thickness of the viscosity-increased portion becomes about 2 to 3 μm as a target value. This allows the viscosity-increased portion to be removed by flushing instead of performing the purging, and further this allows the viscosity-increased portion to be removed by discharging the ink in a normal image recording processing without even performing the flushing. In this case, above described steps S3 and S4 can be omitted.

In the foregoing descriptions, the explanation was given about a case in which the standby position of the discharge head 20 and the irradiation position at which the irradiation with the second UV light source 50 is performed are set at mutually different positions in the space 1*b*. However, in a case that both of the standby position and the irradiation positions are located at a same position, then Step S9 and Step S11 are omitted from the flow chart shown in FIGS. 6A and 6B.

SECOND EXAMPLE

Figure 7:
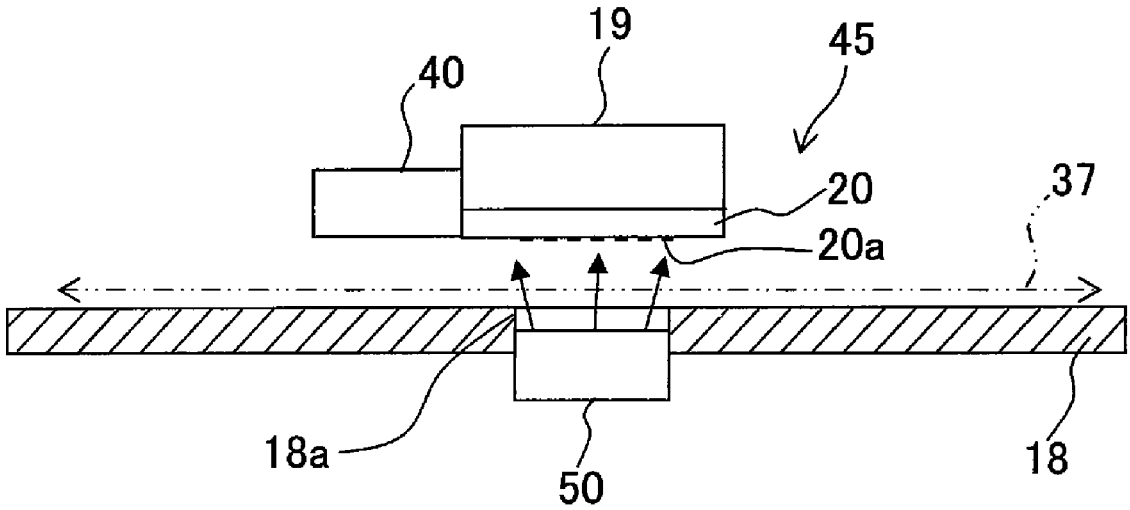
FIG. 7 is a schematic front view of the construction of an ink viscosity-increasing mechanism provided in the ink-discharging apparatus, according to a second example of the present invention.

FIG. 7 is a schematic front view showing the construction of an ink viscosity-increasing mechanism 45 according to a second example. As shown in FIG. 7, in this ink viscosity-increasing mechanism 45, an irradiation position at which ultraviolet ray is irradiated to the nozzles 20*a* is set in the ink discharge area 37 at which image recording on the recording paper can be performed by the discharge head 20, and the second UV light source 50 is arranged at the irradiation position set in the ink discharge area 37. More specifically, a through hole 18*a* vertically penetrating through the platen 18 is formed in the platen 18, and the second UV light source 50 is provided inside the through hole 18 such that the second UV light source 50 does not protrude upwardly beyond the upper surface of the platen 18 and that the second UV light source 50 can irradiate the ultraviolet ray in an upward direction.

With such a construction, there is no need to secure a space, for arranging the second UV light source 50 therein, in the vicinity of a side of the platen 18, which in turn is advantageous that the outer dimension of the ink-discharging apparatus 1 is reduced. Note that since the functions and the operations of the ink-discharging apparatus 1 according to the second example are similar to those of the first example described with reference to FIGS. 5 and 6, any detailed descriptions therefor are omitted.

THIRD EXAMPLE

Figure 8:
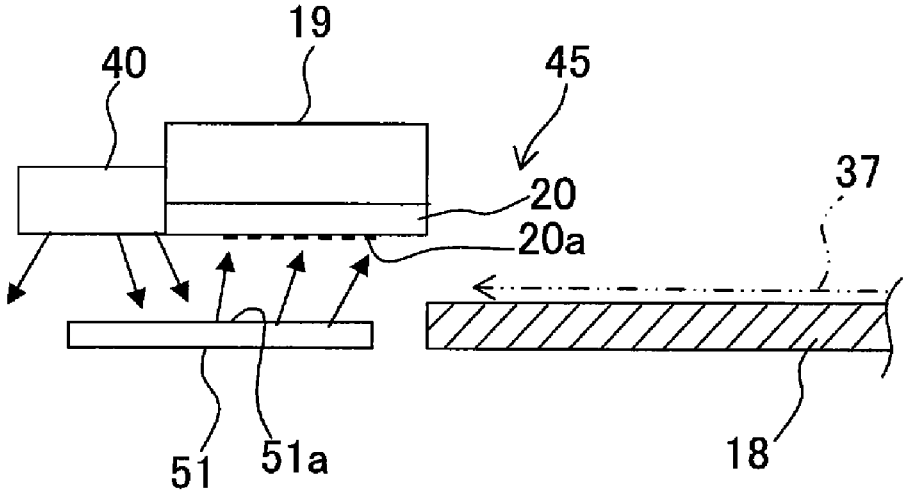
FIG. 8 is a schematic front view of the construction of an ink viscosity-increasing mechanism provided in the ink-discharging apparatus, according to a third example of the present invention.

FIG. 8 is a schematic front view showing the construction of an ink viscosity-increasing mechanism 45 according to a third example. As shown in FIG. 8, the ink viscosity-increasing mechanism 45 is not provided with the above-described second UV light source 50. Instead, the ink viscosity-increasing mechanism 45 of the third example is provided with a reflector 51 (irradiation mechanism) such as aluminum plate. The reflector 51 is arranged in the space 1*b* (see FIG. 3) defined in the vicinity of a side of the platen 18, the space 1*b* being located outside the ink discharge area 37, such that the reflector 51 does not protrude upwardly beyond the upper surface of the platen 18 and that the reflective surface 51*a* of the reflector 51 is directed or oriented upwardly. A position, to which the discharge head 20 is moved and at which the discharge head 20 faces the reflector 51 is the irradiation position where the ultraviolet ray is irradiated to the nozzles 20*a*.

With such a construction, it is possible to use the first UV light source 40 provided in the vicinity of the side of the discharge head 20 to irradiate the ultraviolet ray to the nozzles 20*a* of the discharge head 20. Namely, when the discharge head 20 is positioned at the irradiation position at which the discharge head 20 faces the reflector 51, and the first UV light source 40 is caused to radiate or emit the ultraviolet ray, then the ultraviolet ray radiated from the first UV light source 40 in a downward direction is reflected on the reflective surface 51*a* of the reflector 51 to travel in an upward direction, thereby making it possible to irradiate the ultraviolet ray to the nozzles 20*a*. Therefore, in the ink viscosity-increasing mechanism 45 according to the third example, the first UV light source 40 for preventing the UV ink on the recording paper from permeating into the recording paper can be used also as the light source for irradiating the ultraviolet ray to the nozzles 20*a*.

The function of the ink-discharging apparatus 1 according to the third example is same as that of the ink-discharging apparatus 1 of the first example shown in FIG. 5 (bock diagram) except that the second UV light source 50 and the irradiation driver 62 are omitted from the ink-discharging apparatus 1 of the first example. Similarly, the operation of the ink-discharging apparatus 1 according to the third example is same as that of the ink-discharging apparatus 1 of the first example shown in FIGS. 6A and 6B (flow chart) except that in Step S10, the ultraviolet ray from the first UV light source 40 is irradiated instead of from the second UV light source 50.

Figure 9A:
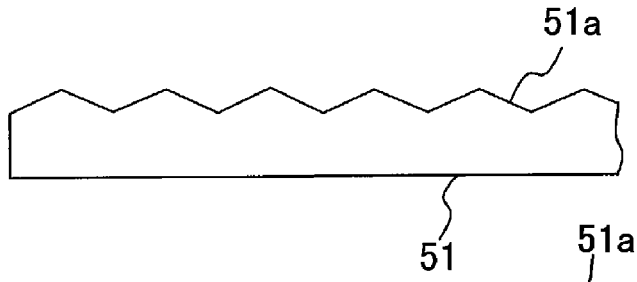
Figure 9B:
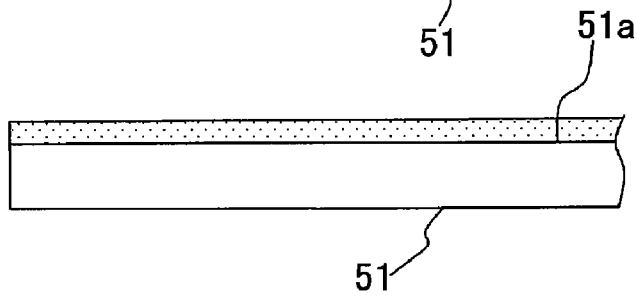
Figure 9C:
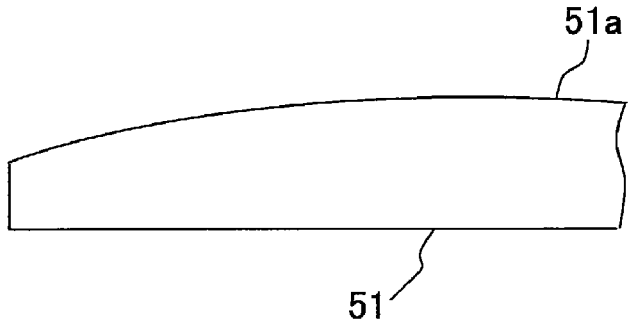

In order to irradiate the ultraviolet ray from the first UV light source 40 to the plurality of nozzles 20*a* in a more uniformized manner, it is also allowable to adopt a construction in which the reflective surface 51*a* of the reflector 51 is constructed to reflect and diffuse the ultraviolet ray from the first UV light source 40. FIGS. 9A to 9C are each a partially enlarged schematic view of construction of the reflector 51, wherein FIG. 9A shows a construction in which concave and convex portions (irregularities) are provided on the reflective surface 51*a*; FIG. 9B shows a construction in which the reflector is provided with a surface layer portion formed of a resin having translucency and a milky white color; and FIG. 9C shows a construction in which the reflector has a reflective surface 51*a* formed as a convexly curved surface. In a case that the concave and convex portions are provided on the reflective surface 51*a* as shown in FIG. 9A, the ultraviolet ray from the first UV light source 40 is diffused upon reflecting on the reflector 51 to be widely irradiated onto the lower surface of the discharge head 20. Thus, the ultraviolet ray can be irradiated, in a substantially uniform manner, to all of the plurality of nozzles 20*a* formed in the discharge head 20. On the other hand, in a case that a surface layer portion located immediately above the reflective surface 51*a* is formed of a translucent resin having a milky white color or the like, the ultraviolet ray from the first UV light source 40 is reflected on the reflective surface 51*a* and then is diffused when passing the milky white surface layer portion. Thus, the ultraviolet ray can be irradiated to all of the plurality of nozzles 20*a* in a substantially uniform manner. Further, as shown in FIG. 9C, by making the entirety of reflective surface 51*a* to be a convexly curved surface, the ultraviolet ray radiated from the first UV light source 40 can be reflected at a wide angle.

Figure 10:
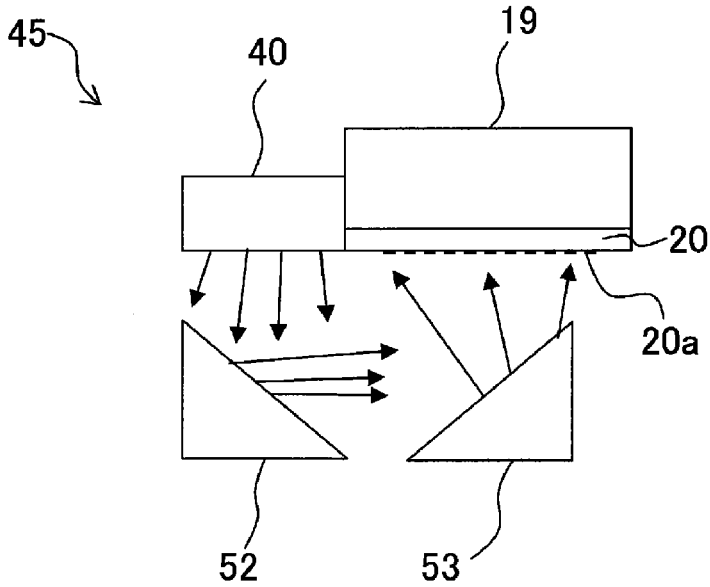
FIG. 10 is a schematic front view of a construction in which the ink viscosity-increasing mechanism has two reflectors.

Further, in order to irradiate the ultraviolet ray from the first UV light source 40 to the nozzles 20*a* in a more ensuring manner, it is allowable to adopt a construction in which a plurality of reflectors are provided. FIG. 10 is a schematic front view showing a construction in which the ink viscosity-increasing mechanism 45 has two reflectors 52, 53. As shown in FIG. 10, the reflector 52 as one of the two reflectors is located at a position at which the reflector 52 faces the first UV light source 40 (at a position under or below the first UV light source 40) when the discharge head 20 is located at the irradiation position, and the reflector 53 as the other of the two reflectors is located at a position at which the reflector 53 faces the discharge head 20 (at a position below or under the discharge head 20) when the discharge head 20 is located at the irradiation position. The reflective surface of the reflector 52 is tilted toward the reflector 53 with respect to the vertically upward direction, and the reflective surface of the reflector 53 is tilted toward the reflector 52 with respect to the vertically upward direction.

Therefore, the ultraviolet ray radiated downwardly from the first UV light source 40 is reflected on the reflector 52 toward the side at which the reflector 53 is located. Then, the ultraviolet ray is reflected on the reflector 53 to be travel upwardly, then the reflected ultraviolet ray arrives at the lower surface of the discharge head 20, thus to be irradiated to the nozzles 20*a*. With this, it is possible to ensure that the ultraviolet ray from the first UV light source 40 is irradiated to the nozzles 20*a* in a more reliable manner.

FOURTH EXAMPLE

Figure 11:
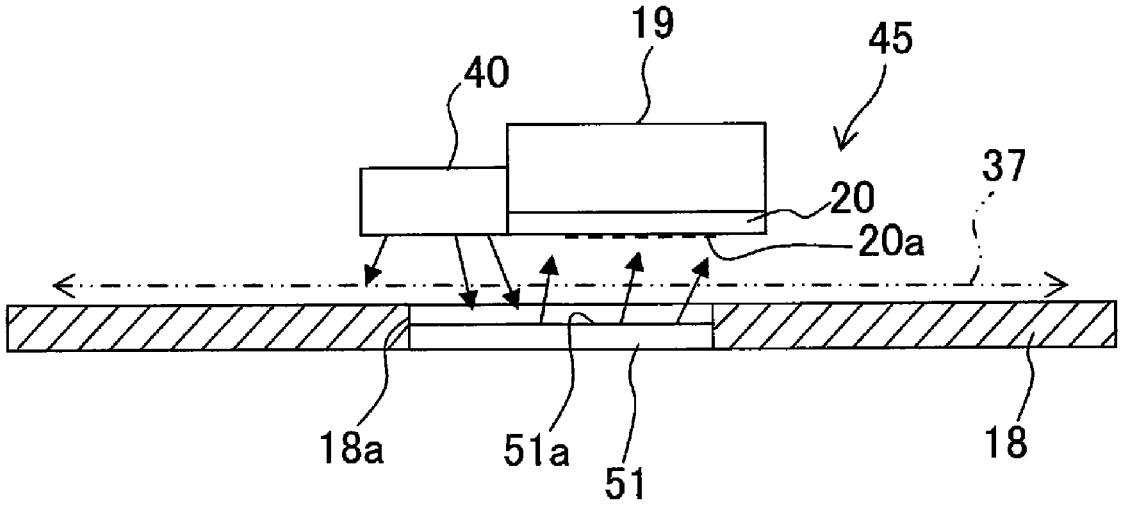
FIG. 11 is a schematic front view of the construction of an ink viscosity-increasing mechanism provided in the ink-discharging apparatus, according to a fourth example of the present invention.

FIG. 11 is a schematic front view showing the construction of an ink viscosity-increasing mechanism 45 according to a fourth example. As shown in FIG. 11, in the ink viscosity-increasing mechanism 45, the irradiation position at which ultraviolet ray is irradiated to the nozzles 20*a* is set in the ink discharge area 37 where image recording on the recording paper can be performed by the discharge head 20, and the reflector 51 is arranged at the irradiation position set in the ink discharge area 37. More specifically, similarly to the platen 18 shown in FIG. 7, a through hole 18*a* vertically penetrating through the platen 18 is formed in the platen 18, and the reflector 51 is provided inside the through hole 18 such that the reflector 51 does not protrude upwardly beyond the upper surface of the platen 18, with the reflective surface 51*a* being oriented upwardly.

With such a construction, similarly to the ink viscosity-increasing mechanism 45 according to the third example, it is possible to use the first UV light source 40 also for irradiating ultraviolet ray to the nozzles 20*a*. In addition, similarly to the ink viscosity-increasing mechanism 45 according to the second example, it is possible to reduce the outer dimension of the ink-discharging apparatus 1.

Since the function and operation of the ink-discharging apparatus 1 according to the fourth example are similar to those of the ink-discharging apparatus 1 of the third example, any detailed descriptions thereof are omitted. Needless to say, the reflectors 51 shown in FIGS. 9A to 9C, and the reflectors 52 and 53 shown in FIG. 10 can be applied to the ink viscosity-increasing mechanism 45 according to the fourth example.

In the above-described embodiment, four color inks, namely cyan ink (C), magenta ink (M), yellow ink (Y) and black ink (Bk) are used. The color of used ink, however, is not limited to these four color inks. For example, in addition to the four color inks of cyan, magenta, yellow and black inks, it is allowable to use light cyan ink, light magenta ink, light yellow ink and light black ink in which contents of colorant are lower than those of the cyan, magenta, yellow and black inks, respectively. In this case, it is allowable to further divide or partition the main tank placing section 8 to form four more accommodating chambers for the light cyan, light magenta, light yellow and light black inks, and to construct the main tank 9 so as to store eight color inks of the cyan ink (C), the magenta ink (M), the yellow ink (Y), the black ink (Bk), and the light cyan ink, the light magenta ink, the light yellow ink, and the light black ink in the accommodating chambers respectively.

In the above-described embodiment, although the ultraviolet ray is irradiated to all of the nozzles 20 formed in the discharge head 20 all at once, the manner in which the ultraviolet ray is irradiated to the nozzles 20*a* is not limited to this. For example, it is allowable to irradiate the ultraviolet ray only to nozzles 20*a*, among the plurality of nozzles 20*a*, corresponding to a color ink, among the color inks, which is used for the recording, etc. Alternatively, it is allowable to irradiate the ultraviolet ray per a nozzles group formed of nozzles, among the plurality of nozzles, corresponding to each of the color inks.

In the above-described embodiment, the timer 67 of the controller 60 measures the elapsed time, and when the elapsed time exceeds or is longer than the preset, predetermined time, the ultraviolet ray is irradiated to the nozzles 20*a* of the discharge head 20. However, the condition for irradiating the ultraviolet ray is not limited to this. For example, when the time at which the recording (printing) is performed is within a predetermined time frame on a predetermined day of the week, the ultraviolet ray may be irradiated. For example, the time at which the recording is performed is from 5 p.m. to 7 p.m. on Friday, then it is assumed any further printing is unlikely to be performed until the next Monday, and thus the ultraviolet ray may be irradiated without waiting the predetermined time to elapse. Alternatively, when a user issues an instruction to switch off the ink-discharging apparatus 1, then it is assumed that the ink-discharging apparatus 1 is unlikely to be used immediately thereafter, and thus the ultraviolet ray may be irradiated before the ink discharge apparatus is switched off.

In the above-described embodiment, although the first UV light source 40 is provided integrally with the discharge head 20 at a side of the discharge head 20, the place at which the first UV light source 40 is arranged is not limited to this provided that the ultraviolet ray can be irradiated to the UV ink discharged from the discharge head 20 and adhered to the recording surface of the recording medium. For example, the first UV light source 40 may be provided above or over the downstream portion of the straight path 25 such that the first UV light source 40 extends in a sliding (moving) direction in which the discharge head 20 slidably moves.

The embodiment as described above is an example in which the present invention is applied to a multi-function machine having the printer function, scanner function, copy function, and facsimile function. However, the present invention is applicable to any apparatus other than the multi-function machine, provided that the apparatus is provided with a printer which discharges the UV ink regardless of the presence or absence of the functions other than the printer function.

The above-described embodiment is an example in which the present invention is applied to an ink-discharging apparatus which discharges a UV ink of which viscosity is increased and is cured by receiving ultraviolet ray. However, the kind of inks to be discharged is not limited to the UV ink. For example, the present invention is applicable to an ink-discharging apparatus, for example, discharging an infrared ray-curable ink of which viscosity is increased and is cured by receiving infrared ray or discharging a neutron ray-curable ink of which viscosity is increased and is cured by receiving neutron ray as particle ray. In this case, as the first and second light sources, it is allowable to use, for example, a light source which radiates infrared or neutron ray.

What is claimed is:

1. An ink-discharging apparatus comprising:

a discharge head having a nozzle to discharge an ink, of which viscosity is increased when a predetermined energy ray is irradiated to the ink, onto a recording medium;

a first light source which radiates the predetermined energy ray; and an irradiation mechanism configured to irradiate the nozzle with an energy ray for increasing the viscosity of the ink at the nozzle;

a controller configured to control the discharge head and the irradiation mechanism and to receive an image-recording instruction inputted to the ink-discharging apparatus, wherein the controller controls the irradiation mechanism to irradiate the nozzle with the energy ray when a predetermined time has elapsed since the discharge head last discharged the ink, and wherein the controller controls the irradiation mechanism not to irradiate the nozzle with the energy ray when the controller receives the image-recording instruction before the predetermined time has elapsed since the discharge head last discharged the ink.

2. The ink-discharging apparatus according to claim 1, wherein the discharge head is configured to move between an ink discharge area in which the discharge head discharges the ink and a standby position at which the discharge head stands by without discharging the ink, and the controller controls the irradiation mechanism to irradiate the nozzle with the energy ray when the discharged head stands by at the standby position for more than a predetermined standby time.

3. The ink-discharging apparatus according to claim 1, wherein each of the predetermined energy ray and the energy ray irradiated to the nozzle is a light.

4. The ink-discharging apparatus according to claim 3, wherein the light is ultraviolet ray; the first light source is a UV light source which radiates the ultraviolet ray; and the ink is a UV-curable ink of which viscosity is increased and is cured by being irradiated with the ultraviolet ray.

5. The ink-discharging apparatus according to claim 4, the first light source and the discharge head are integrally formed.

6. The ink-discharging apparatus according to claim 4, wherein the ultraviolet ray which the irradiation mechanism irradiates to the nozzle is the ultraviolet ray which is radiated by the first light source.

7. The ink-discharging apparatus according to claim 6, wherein the controller controls the first light source to perform the radiation so that the ultraviolet ray is irradiated to the nozzle after the predetermined time is elapsed since the discharge head discharged the ink onto the recording medium last time.

8. The ink-discharging apparatus according to claim 4, wherein the first light source is arranged to face a recording surface, of the recording medium, which receives the ink from the discharge head; and the irradiation mechanism is a reflector which reflects the ultraviolet ray from the first light source to make the ultraviolet ray to be irradiated to the nozzle of the discharge head.

9. The ink-discharging apparatus according to claim 8, wherein the reflector is arranged outside an ink discharge area in which the discharge head discharges the ink onto the recording medium.

10. The ink-discharging apparatus according to claim 8, wherein the reflector is arranged inside an ink discharge area in which the discharge head discharges the ink onto the recording medium.

11. The ink-discharging apparatus according to claim 8, wherein the reflector is formed to have a reflective surface, wherein the reflective surface reflects to diffuse the ultraviolet ray from the first light source.

12. The ink-discharging apparatus according to claim 4, wherein the irradiation mechanism is a second light source which radiates the ultraviolet ray to the nozzle; the first light source is arranged to face a recording surface, of the recording medium, which receives the ink from the discharge head; and the second light source is arranged to face the nozzle of the discharge head.

13. The ink-discharging apparatus according to claim 12, the second light source is arranged outside an ink discharge area in which the discharge head discharges the ink onto the recording medium.

14. The ink-discharging apparatus according to claim 12, the second light source is arranged inside an ink discharge area in which the discharge head discharges the ink onto the recording medium.

15. The ink-discharging apparatus according to claim 12, wherein the controller controls the second light source to perform the radiation so that the ultraviolet ray is irradiated to the nozzle after the predetermined time is elapsed since the discharge head discharged the ink onto the recording medium last time.

16. An image-recording method for recording an image on a recording medium, the method comprising:

receiving an image-recording instruction;

discharging an ink, of which viscosity is increased when an energy ray is irradiated to the ink, from a nozzle formed in a discharge head onto the recording medium based on the image-recording instruction;

irradiating an energy ray to the ink discharged onto the recording medium;

irradiating the nozzle with an energy ray for increasing the viscosity of the ink at the nozzle irradiating the nozzle with the energy ray when a predetermined time has elapsed since the ink was last discharged; and preventing from irradiating the nozzle with the energy ray when the image-recording instruction is received before the predetermined time has elapsed since the ink was last discharged.

17. The image-recording method according to claim 16, wherein the ink of which viscosity is increased when the energy ray is irradiated to the ink is an ink of which viscosity is increased when light is irradiated to the ink; and each of the energy ray irradiated to the ink discharged onto the recording medium and the energy ray irradiated to the nozzle is light.

18. The image-recording method according to claim 17, wherein the light is ultraviolet ray.

19. The image-recording method according to claim 18, wherein a meniscus is formed with the ink in the nozzle, and the ink forming the meniscus is cured by irradiating the ultraviolet ray to the nozzle.

20. The image-recording method according to claim 19, further comprising:

removing the cured ink by applying discharge pressure to the ink in the nozzle.

21. The image-recording method according to claim 18, wherein the ultraviolet ray irradiated to the nozzle is the ultraviolet ray to be irradiated to the ink discharged onto the recording medium; and the ultraviolet ray is irradiated to the nozzle by reflecting the ultraviolet ray to be irradiated to the ink discharged onto the recording medium.

22. The image-recording method according to claim 21, further comprising:

measuring an elapsed time elapsed since the ink is discharged from the nozzle last time; and comparing the measured elapsed time with the predetermined time;

wherein the ultraviolet ray is irradiated to the nozzle when the measured elapsed time is longer than the predetermined time.

23. The image-recording method according to claim 21, further comprising moving the discharge head to a position at which the discharge head does not face the recording medium and irradiating the ultraviolet ray to the nozzle.

24. The image-recording method according to claim 16, wherein a portion of the ink, in which a viscosity of the ink is increased by the irradiation at the nozzle, has a thickness of about 2 to 3 μm.

25. The image-recording method according to claim 16, further comprising the steps of:

selectively moving the discharge head between an ink discharge area in which the ink is discharged from the discharge head and a standby position at which the discharge head stands by without discharging the ink; and irradiating the nozzle with the energy ray when the discharge head stands by at the standby position for more than a predetermined standby time.

* * * * *